United States Patent [19]

Bullock

[11] 4,111,131

[45] Sep. 5, 1978

[54] RESILIENT RAILROAD CAR TRUCK

[75] Inventor: Robert L. Bullock, Lombard, Ill.

[73] Assignee: Standard Car Truck Company, Chicago, Ill.

[21] Appl. No.: 650,522

[22] Filed: Jan. 19, 1976

[51] Int. Cl.[2] ..... B61F 3/08; B61F 5/30; B61F 5/38; B61F 5/50

[52] U.S. Cl. ..... 105/224.1; 105/167; 105/176

[58] Field of Search ..... 105/224.1, 176, 167; 267/3, 4, 63 A

[56] References Cited

U.S. PATENT DOCUMENTS

| | | | |
|---|---|---|---|
| 33,167 | 8/1861 | Youmans | 105/176 X |
| 986,185 | 3/1911 | Lincoln | 105/176 X |
| 2,068,279 | 1/1937 | Piron | 267/63 A |
| 2,137,543 | 11/1938 | Piron | 105/224.1 |
| 2,197,727 | 4/1940 | Ledwinka | 105/224.1 X |
| 2,782,026 | 2/1957 | Hirst | 267/63 A X |
| 2,802,662 | 8/1957 | Hirst | 105/224.1 X |
| 3,380,400 | 4/1968 | Barber | 105/224.1 X |
| 3,528,374 | 9/1970 | Wickens | 105/176 X |
| 3,539,170 | 11/1970 | Hamel | 267/63 A |
| 3,575,403 | 4/1971 | Hamel et al. | 267/63 A |
| 3,839,969 | 10/1974 | Thum | 105/224.1 |

*Primary Examiner*—Drayton E. Hoffman
*Assistant Examiner*—Howard Beltran
*Attorney, Agent, or Firm*—Kinzer, Plyer, Dorn & McEachran

[57] ABSTRACT

A railroad car truck has a pair of wheelsets and means for providing relative restraint between wheelsets. A pair of side frames are supported on the wheelsets through resilient pads with the resilient pads providing greater shear resistance in a lateral direction than in a longitudinal direction.

11 Claims, 9 Drawing Figures

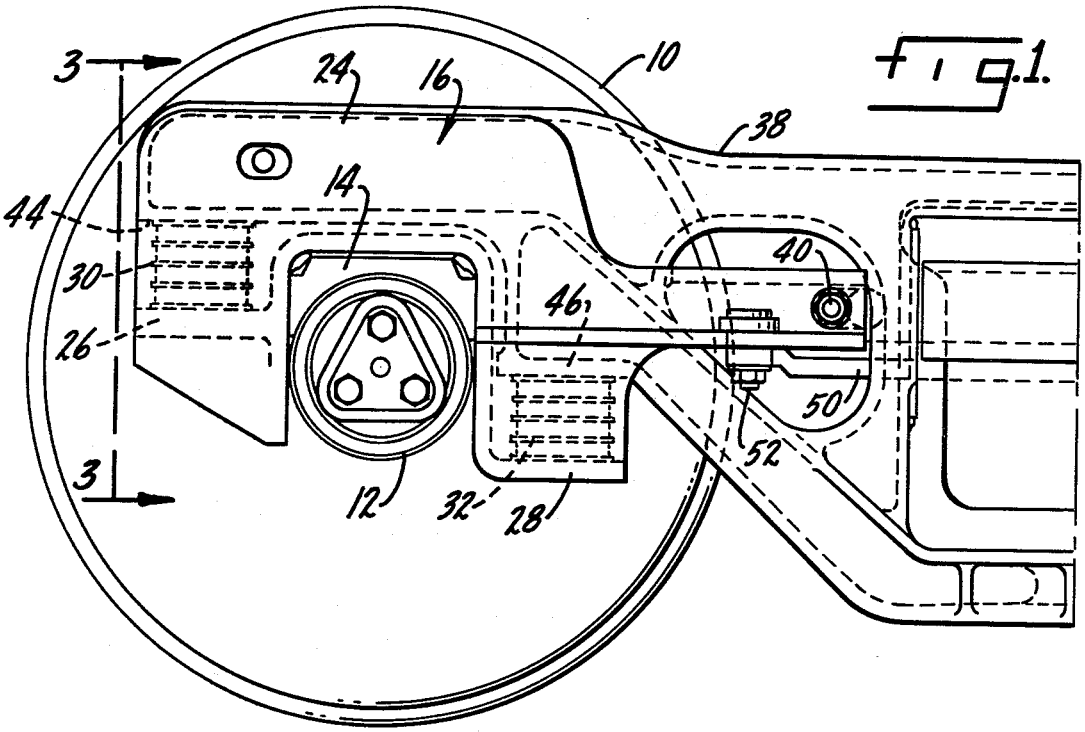
fig.1.
fig.2.
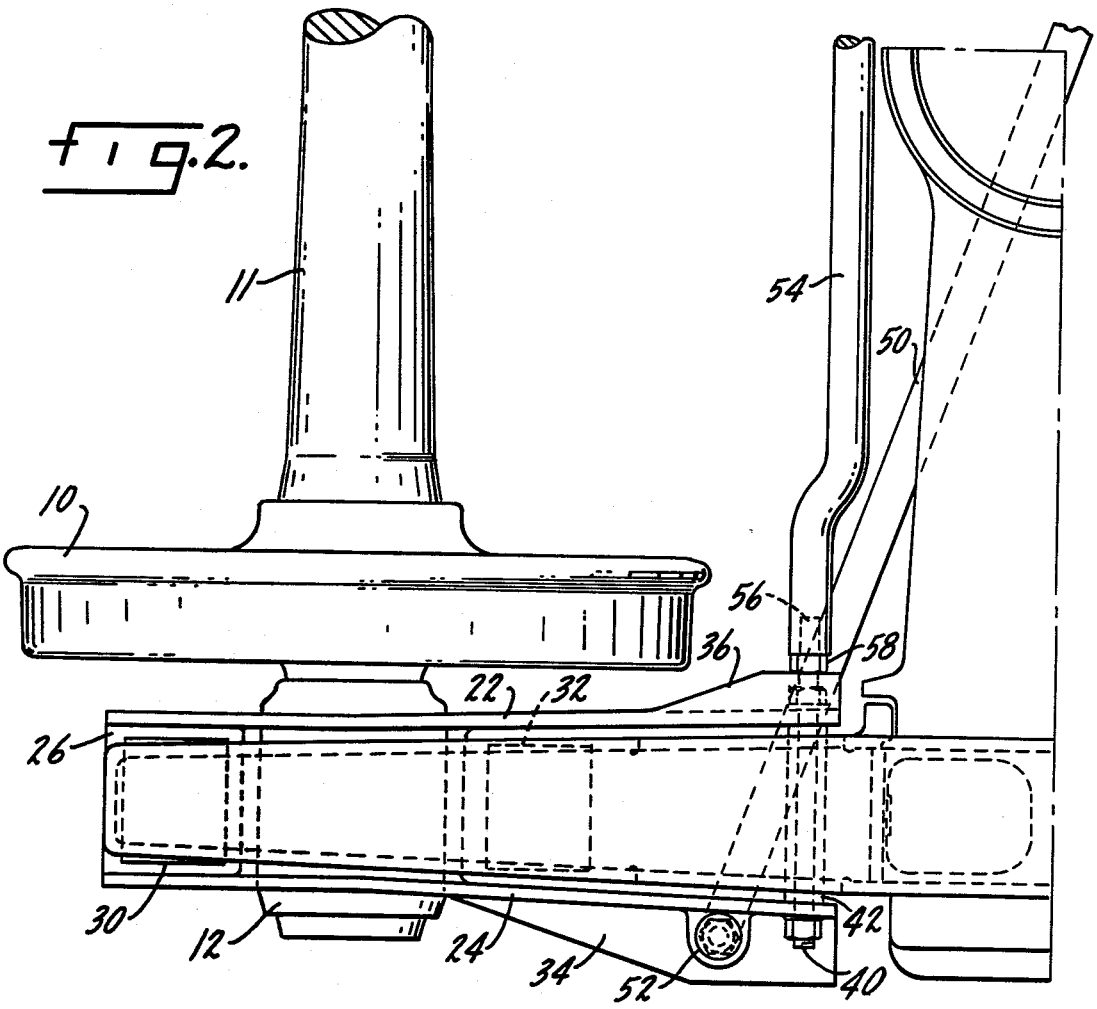

fig.3.
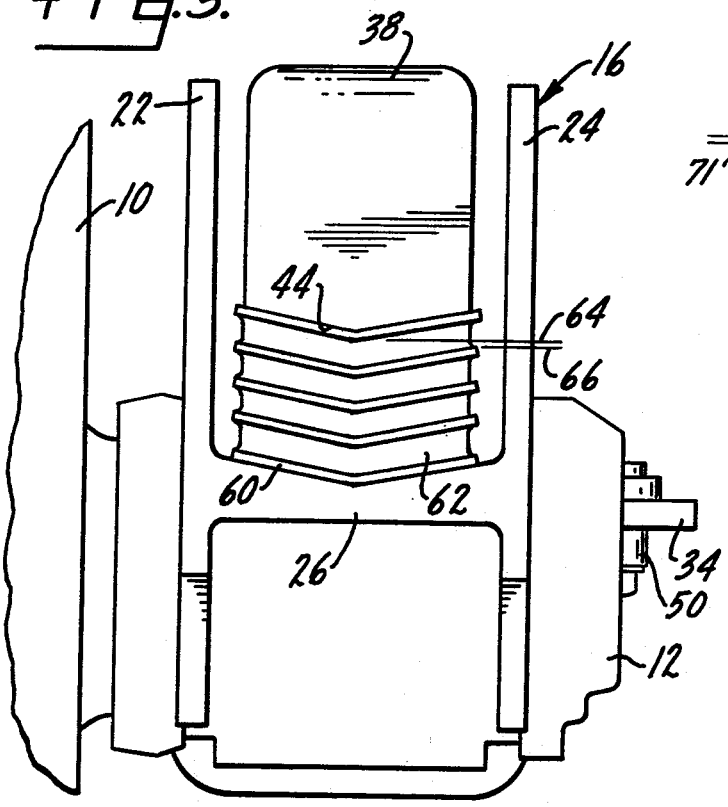
fig.4.
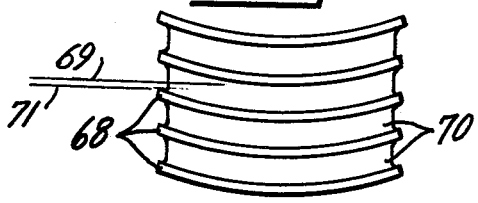
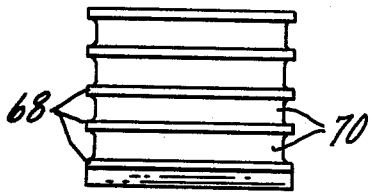
fig.5.
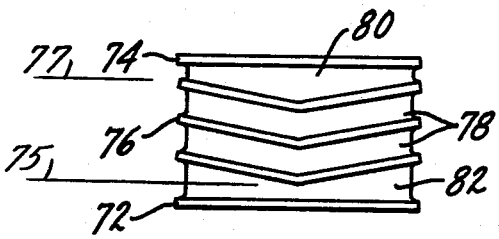
fig.6.
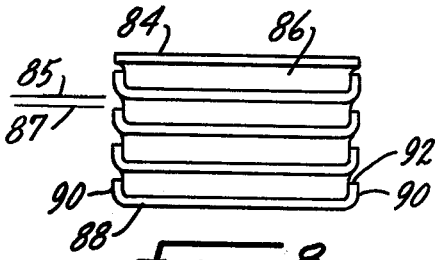
fig.8.
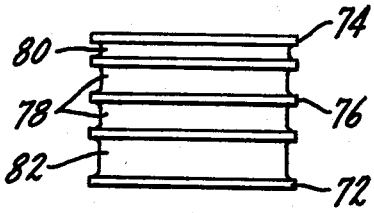
fig.7.
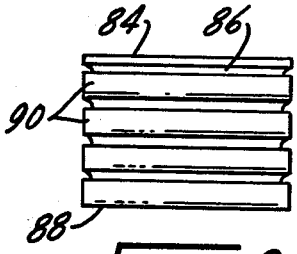
fig.9.

RESILIENT RAILROAD CAR TRUCK

SUMMARY OF THE INVENTION

The present invention relates to railroad car trucks and in particular to resilient pads for supporting the side frames on the wheelsets.

One purpose is a stabilized self-steering railroad car truck utilizing resilient pads for mounting the side frames on the wheelsets which pads have greater shear resistance in the lateral direction than in the longitudinal direction.

Another purpose is a resilient pad for the use described in which there is less volume of distortable resilient material in one direction than in the other.

Another purpose is a railroad car truck of the type described including resilient pads having alternate layers of resilient and non-resilient material in which the non-resilient layers limit the volume of material distortable in the lateral direction.

Other purposes will appear in the ensuing specification, drawings and claims.

BRIEF DESCRIPTION OF THE DRAWINGS

The invention is illustrated diagrammatically in the following drawings wherein:

FIG. 1 is a partial side view of a railroad car truck of the type described, FIG. 2 is a partial top view of the structure of FIG. 1, FIG. 3 is partial end view, on an enlarged scale, of the structure of FIGS. 1 and 2, FIG. 4 is an end view of a modified form of resilient pad, FIG. 5 is a side view of the pad of FIG. 4, FIG. 6 is an end view of yet a further form of resilient pad, FIG. 7 is a side view of the pad of FIG. 6, FIG. 8 is an end view of a modified form of resilient pad, and FIG. 9 is a side view of the pad of FIG. 8.

DESCRIPTION OF THE PREFERRED EMBODIMENT

Recent developments in the railroad car truck field, particularly on the part of Herbert Scheffel of the South African Railways, have provided a truck which is both self-steering and stabilized over a wide speed range for both empty and loaded conditions. The truck developed by Mr. Scheffel has a predetermined wheel profile providing generally constant conicity regardless of the relative position of the wheels to the rail. In addition to a profiled conicity, the Scheffel car truck provides low wheelset yaw constraint, releasing the wheelsets to follow the rail profile, thus making the truck substantially self-steering. The wheelsets are not rigidly fixed to the side frames, but instead are restrained relative to each other by crossed anchors or by similar and equivalent mechanical means.

In United States railroad practice it is not always possible to have consistent wheel profile because of the multitude of different railroads and car builders and due to the fact that wheels are often run in this country with what is known as a "hollow worn" profile. In experiments with the Scheffel truck in the United States, it has been determined that trucks having a "hollow worn" profile do not have the stability of the Scheffel truck even though they utilize the other parameters of Scheffel's design. The present invention provides a truck which is self-steering and stabilized even though the wheels be "hollow worn" or in any event not of the specific Scheffel profile.

With the Scheffel predictable conicity, it is possible to accurately predict the force input to the wheelsets and thus design the truck to provide stability. The wave form representing force input in a Scheffel truck with predictable conicity is relatively stable and itself predictable, thus permitting the application of known spring rates, etc. to retain stability. On the contrary, with a hollow worn wheel, it is not possible to accurately predict the force input and the vibration wave form showing lateral movement of the wheelset is quite complex. Additional means must be provided to damp vibration of the wheelset. In the present invention this is accomplished by providing greater shear resistance in the lateral direction than in the longitudinal direction. This enables the truck to retain the self-steering characteristics described above while at the same time overcoming the instability caused by hollow worn wheels. The longitudinal shear resistance is not varied, as under the Scheffel design there must be a low yaw constraint. The lateral shear resistance is increased by changing the mechanical configuration of the resilient shear pads which support the side frames on the wheelset.

The mechanical change which effectively varies the lateral shear resistance provides less elastomeric or rubberlike material to receive the lateral shear forces than is available to receive the longitudinal shear forces. Because there is less elastomeric material available to receive the lateral shear forces, the effective spring rate in the lateral direction is increased. However, substantially greater damping is provided because there is less volume of elastomeric material available to accept the shear force. In the particular range utilized in the present invention, the gain in damping far outweighs any loss in stability through the increase in spring rate.

Looking particularly at FIGS. 1, 2 and 3, only a portion of the railroad car truck has been shown. It should be understood that the truck is symmetrical about its center point and only a quadrant, looking at the top of the truck, will be described and shown.

A wheelset 10 having a conventional axle 11 will be mounted within a roller bearing 12. A roller bearing adapter 14 is supported by the roller bearing and itself supports a roller bearing housing indicated generally at 16. Housing 16, as particularly shown in FIG. 2, has side walls 22 and 24 which are interconnected by integral supports 26 and 28. Support 26 mounts a resilient pad 30 and support 28 mounts a similar pad 32. The pads are identical and will be described in detail hereinafter.

Roller bearing housing side walls 22 and 24 each have a horizontally-extending arm, 34 and 36, respectively, on the outboard and inboard sides. Side frame 38, as is conventional, may have various openings and a stiffening bolt 40 surrounded by a sleeve 42 extends through one such opening to connect arms 34 and 36.

Side frame 38 has bearing surfaces 44 and 46 which directly rest upon pads 30 and 32, as particularly shown in FIG. 1, so that the side frame is supported by the pads which in turn are supported by roller bearing housing 16 which in turn is supported directly on the wheelsets. It should be understood that the car truck will include a conventional bolster, springs, brake means and the like, all of which are known in the art.

The opposite corners of each wheelset are connected together by cross anchors, one of which is indicated at 50. Anchor 50 is pivotally attached to outboard arm 34 of housing 16, by a bolt 52, and extends through an opening in side frame 38, through the conventional bolster to a similar mounting on the opposite side of the other wheelset of the pair of wheelsets conventionally forming a car truck. Rod 50 provides the restraint between wheelsets required in a truck of the Scheffel design.

A cross strut 54, which is used to prevent the application of a horizontal turning force on roller bearing 12, is connected in parallel with the wheelset and will be attached to inboard arm 36 by a stud 56, which may be integral with bolt 42, and a nut 58.

Pads 30 and 32, which may be identical and are positioned on opposite sides of roller bearing 12, with one pad being above the center line of axle 11 and the other pad being below, are shown particularly in FIG. 3. The pad is formed by alternate layers of steel plates 60 and a rubber or elastomeric or resilient cushion 62. The number of resilient layers and the number of steel plates will vary. In order to provide greater shear resistance in the lateral direction than in the longitudinal direction, a cross section through the pad on a plane perpendicular to the side frame or parallel to the wheelset indicates a domed or arched construction. Each of the plates and the intermediate rubber layers are somewhat wedge-shaped or dome-shaped or are in the shape of an arch, with the apex of the arch being generally centrally located, although this is not necessary. The effective volume of resilient material which can distort under a lateral shear force is that volume of rubber which is not restrained by the adjacent steel plates. Looking particularly at FIG. 3, the available volume of rubber to receive lateral shear forces is that between a line 64 drawn from the apex of one plate 60 and a line 66 drawn through the opposite sides of an adjacent plate 60. This is the only volume of rubber which is not constrained by the plates 60 and thus the only volume of rubber which is available for lateral shear resistance. On the contrary, the entire volume of rubber is available for longitudinal shear resistance as there is no mechanical restraint upon it. Thus, the lateral shear resistance is substantially greater than the longitudinal shear resistance providing the result described above.

FIGS. 4 and 5 show an alternate pad construction. In this case plates 68 are positioned on opposite sides of resilient layers 70 with the entire construction being arcuate in cross section along a plane parallel to the wheelset. The available rubber for receiving lateral shear forces is that between a line tangent with one surface of a plate 68 (line 69) and a line drawn through the opposite edges of the next adjacent plate (line 71). Note that again there is no longitudinal restraint on the volume of rubber which can receive the longitudinally directed shear forces.

FIGS. 6 and 7 show a modified form of pad which does not require any variation in the surface configuration of supports 26 and 28 over and above that which would be necessary if the resilient pad had a totally flat configuration. In this instance, bottom and top plates 72 and 74 are flat with intermediate plates 76 being formed in the manner shown in FIGS. 2 and 3. The intermediate rubber layers 78 are the same as that of FIG. 3 with the same reduction in the volume of rubber available to receive the lateral shear forces. Top rubber layer 80 and bottom layer 82 will provide a volume of available rubber, depending upon their thickness, which may be the same as or different from that of intermediate layers 78. Again, the volume available is that between the flat surface of the plate and either the apex of the next adjacent plate (line 75) or a line drawn between the opposite sides of the next adjacent plate (line 77).

In the construction of FIGS. 8 and 9, top plate 84 is flat and all intermediate rubber layers 86 are generally identical. Each of the remaining plates 88 have longitudinally extending flanges 90 which restrict the volume of rubber available to receive lateral shear forces to that portion of each rubber layer between a flat plate surface (line 85) and the top edge 92 of the flanges (line 87). Thus, again the amount of material available for receiving lateral shear forces has been restricted by a mechanical means without in any way affecting the amount of material available to receive longitudinal shear forces.

The invention should not be limited to any specific or particular mechanical pad configuration, although the various examples shown are all quite satisfactory. It is important to provide means for increasing the lateral shear resistance in a car truck design of the type described without affecting the longitudinal shear resistance.

Whereas the preferred form of the invention has been shown and described herein, it should be realized that there may be many modification, substitutions and alterations thereto.

The embodiments of the invention in which an exclusive property or privilege is claimed are defined as follows:

1. In a railroad car truck having a pair of wheelsets and means for providing relative restraint between wheelsets, a pair of side frames, means for supporting said side frames on said wheelsets including resilient means supported on said wheelsets and supporting said side frames, said resilient means providing greater shear resistance in a lateral horizontal direction than in a longitudinal horizontal direction and including a pair of spaced pad elements supported on opposite sides of each wheelset axis, each pad element including alternate resilient and generally rigid layers, with at least one of the generally rigid layers on opposite sides of at least one resilient layer being shaped to restrict the volume of material distortable in the lateral direction whereby there is less volume of distortable material in the lateral direction than in the longitudinal direction.

2. The structure of claim 1 further characterized in that at least a majority of said generally rigid layers include means for limiting distortion of an adjacent resilient layer in the lateral direction.

3. The structure of claim 2 further characterized in that the generally rigid layer means for limiting distortion of a resilient layer includes flange-like extensions on opposite longitudinal sides of said generally rigid layers.

4. The structure of claim 2 further characterized in that said alternate resilient and generally rigid layers have an arcuate cross section in a plane perpendicular to the side frame.

5. The structure of claim 2 further characterized in that said alternate resilient and generally rigid layers have a dome-shaped cross section in a plane perpendicular to the side frame.

6. The structure of claim 5 further characterized in that said dome-shaped cross section has a generally centrally located apex.

7. The structure of claim 1 further characterized in that said alternate resilient and generally rigid layers have at least one resilient layer and adjacent generally rigid layers with a dome-shaped cross section in a plane perpendicular to the side frame.

8. A resilient pad for use in supporting a railroad car truck side frame on a wheelset including alternate resilient and generally rigid layers, with at least one of the generally rigid layers on opposite sides of at least one resilient layer being shaped to restrict the volume of material distortable in a horizontal direction parallel with the wheelset whereby there is less volume of distortable material in a horizontal direction parallel with the wheelset than in a horizontal direction perpendicular to the wheelset.

9. The structure of claim 8 further characterized in that at least a majority of said generally rigid layers include means for limiting distortion of an intermediate resilient layer in the parallel direction.

10. The structure of claim 9 further characterized in that said generally rigid layers have flange-like extensions on opposite sides thereof.

11. The structure of claim 8 further characterized in that a resilient layer and adjacent generally rigid layers have a generally dome-shaped cross section in a plane parallel to a wheelset.

* * * * *